United States Patent [19]

Johnson, Jr.

[11] Patent Number: 4,777,765

[45] Date of Patent: Oct. 18, 1988

[54] ADJUSTABLE WIDTH DOORWAY SAFETY GATE APPARATUS

[76] Inventor: Stanley A. Johnson, Jr., 2575 Maple Hill Dr., Brookfield, Wis. 53005

[21] Appl. No.: 83,037

[22] Filed: Aug. 6, 1987

Related U.S. Application Data

[63] Continuation-in-part of Ser. No. 870,550, Jun. 4, 1986, Pat. No. 4,702,036.

[51] Int. Cl.[4] ..... E06B 3/68

[52] U.S. Cl. ..... 49/55; 49/57; 49/395

[58] Field of Search ..... 49/55 X, 56, 57 X, 395 X; 256/73, 26; 160/225, 228, 135

[56] References Cited

U.S. PATENT DOCUMENTS 2,581,857 1/1952 Harrison ..... 49/55 X 2,855,037 10/1958 Stiffel ..... 160/135

4,583,715 4/1986 Wright ..... 49/55 X

*Primary Examiner*—Philip C. Kannan

*Attorney, Agent, or Firm*—Robert T. Johnson

[57] ABSTRACT

Adjustable width doorway safety gate apparatus of this invention discloses a gate comprised of two segments slidably adjustable to variable width doorways and hinges mounted on outer vertical edge of one gate segment, with the hinges consisting of hinge pins pointed downward and fitting in hinge pin sockets mounted on a spring loaded pole or on a doorway pillar and the two gate segments are locked to width by means of a lock spool segment extending through aligned holes in slots in center bar of gate segments, and the center bars ride on offset grooves and matching runners of the center bars, and gate locking upper and lower U latches acting in concert, activated by release of gate lock flexible lever release.

3 Claims, 7 Drawing Sheets

(SECTION A-A)

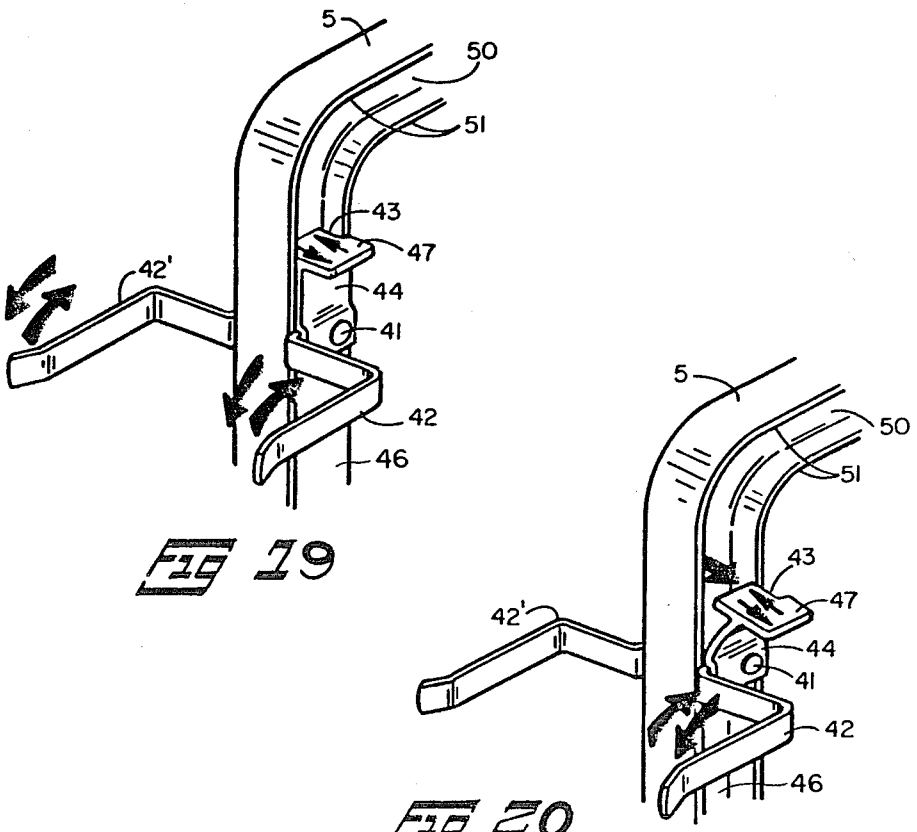
FIG 19
FIG 20
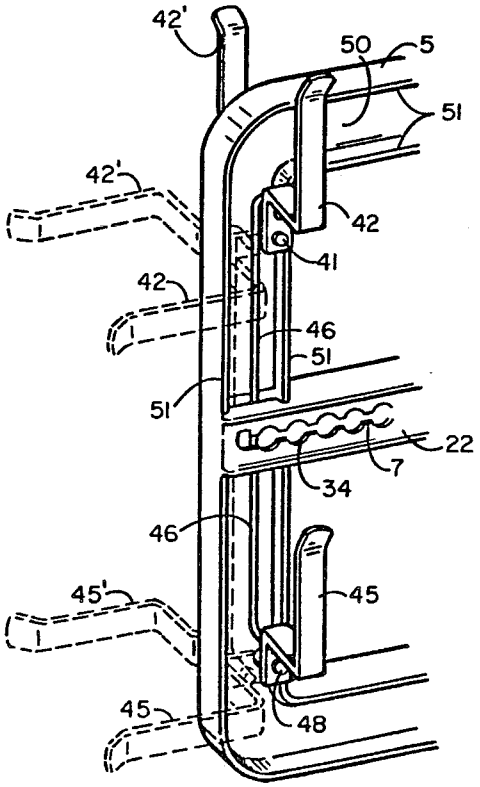
FIG 18

(SECTION B-B)

ADJUSTABLE WIDTH DOORWAY SAFETY GATE APPARATUS

This is a continuation in part of application filed 6/4/86 having Ser. No. 06/870,550, which matured into Pat. No. 4,702,036 dated 10/27/87.

FIELD OF THE INVENTION

This invention pertains to a safety gate mounted in a doorway, and is of great value in protecting of babies, by not allowing them through doorways in which the gate is mounted. This invention can be identif ied as "adjustable width doorway safety gate apparatus".

The above mentioned previous application disclosed a gate of two segments, each segment of which is mounted on hinges attached to the pillars of a door f rame and adaptable to various doorway widths, by overlap of the two segments.

This present application is to disclose an adjustable width safety gate of two segments adjusted to the width of a doorway and fastened each to the other, hinged on one edge and locking means on the edge opposite the mounting hinge.

Further disclosure is made of mounting an adjustable width doorway safety gate on a hinge segment attached to a spring loaded pole, mounted adjoining a doorway pillar and a closing latch attached to the safety gate vertical section on the gate end opposite the hinged vertical gate end.

BRIEF SUMMARY OF INVENTION

This present invention for "Adjustable Width Doorway 8afety Gate Apparatus" discloses safety gate apparatus comprised of two gate halves adjustably fitted together by means of fasteners extending through horizontal slots in center bar segments of each gate half. The total gate width is adjusted to doorway width by means of releasing finger lock extending through aligned expanded portions called holes, in slots in center bar segments. The gate apparatus is mounted on a hinge attached to a vertical side of the gate. The hinge is comprised of downward pointing finger pins attached to the vertical side of the gate and these downward pointing finger pins fit in finger pin bearing sockets mounted on the door frame pillar. There are many instances where the door frame pillar is not suitable for mounting of the finger pin bearing sockets, and in view of this, disclosure is made oi mounting the finger pin bearing sockets on a spring loaded pole erected in the door frame. The spring loaded pole comprises a compression spring mounted in the pole section and adjustment of the compression spring is so made that the pole is rigidly held in the doorway, to support the gate mounted on the hinge attached to the pole. The assembled gate is held in closed position by upper and lower gate lock U latches joined together by a leg joining the upper and lower latches, and a gate lock flexible lever release to actuate the gate lock U latches. The gate lock U latches straddle either the doorway pillar or a spring loaded pole mounted at the vertical edge of the swinging gate.

PRIOR ART PERTAINING TO THIS INVENTION

U.S. Pat. No. 139,232 to Boughton for "Nursery Gates" This patent discloses an expandable gate which locks on one end, U.S. Pat. No. 141,677 to Tuttle for "Nursery Gates", This patent discloses an adjustable width gate which is raised to open and lowered for closing - no hinges are involved.

U.S. Pat. No. 4,492,263 to Gebhard for "Infant Security Door Gate Assembly". This gate is an assembly of two segments, expandable by sliding on telescoping rods.

U.K. Pat. No. 2,041,051 to Adams for "Baby Gates". This is for an adjustable width gate, hinged on one end and locking on the opposite end.

U.S. Pat. No. 942,502 to Jablonovsky for "Adjustable Window Grate". This discloses twp pairs of grate sections, with the two pairs to be fitted together.

Patent (French) No. 1,236,542 to perrier see FIGS. 1–7. This barrier does not swing free.

Other patents of interest are:

U.S. Pat. No. 2,662,242 to Hess

U.S. Pat. No. 4,465,262 to Itri

U.S. Pat. No. 4,566,222 to Hatvany,

None of the above patents touch the disclosure of this invention as described below.

OBJECTS OF THE INVENTION

One of the objects of this invention is to disclose a doorway safety gate, mounted on a removable f rame, adjustable to fit in any width doorway, said doorway safety gate comprised of two gate segments attached together to attain a width to span a doorway.

Another object of this invention is to disclose an adjustable width doorway safety gate comprised of two overlapped segments attached together to attain a suitable width to span a doorway, and mounting of the overlapped segments attached together on a hinge consisting of downward pointing fingers or pins on one vertical edge of the safety gate and the fingers or pins fitting in pin bearing sockets mounted on the door frame pillar.

Another object of this invention is to disclose an adjustable width doorway safety gate comprised of two overlapped segments attached together to attain a suitable width to span a doorway, and mounting of the overlapped segments attached together on a hinge consisting of downward pointing fingers or pins on one vertical edge of the safety gate comprised of the overlapped segments, and the fingers or pins fitting in pin bearing sockets attached to a spring loaded vertical pole, mounted adjoining the door frame pillar.

Another object of this invention is to disclose a doorway safety gate comprised of two gate segments, said gate segments slidably adjustable to fit in various door frame widths and mounted on hinges consisting of downward pointing fingers or pins on edge of gate end, said fingers or pins fitting in pin bearing sockets mounted on vertical spring loaded pole located in doorway and the pole extending from threshold to top of door frame.

Another object of this invention is to disclose a doorway safety gate comprised of two segments, adjustable to fit in variable width door frames, the gate segments mounted on the frame by hinges of downward pointing finger pins attached to a vertical side of gate end and the downward pointing finger pins fitting in pin bearing sockets mounted on a vertical spring loaded pole positioned in the door frame and the pole extending from the threshold to top of door frame casing.

Another object of this invention is to disclose a doorway safety gate comprised of two segments, the gate segments attached together and adjustable to fit in variable width door frames the gate segments mounted on the frame by hinges of downward pointing finger pins attached to an outer vertical side of one gate segment edge and said downward pointing finger pins fitting in pin bearing sockets mounted on vertical spring loaded pole mounted in door frame.

Another object of this invention is to disclose an adjustable frame comprising spring loaded vertical pole having mounted thereon pin bearing sockets, said pin bearing sockets to accommodate gate hinge section comprising downward pointing finger pins attached to the gate edge section.

The doorway safety gate assembly can also be hung on a doorway pillar by means of hinges comprised of downward pointing finger pins attached to an outer vertical edge of the gate and the finger pins fitting in pin bearing sockets mounted on door frame pillar.

Another object of this invention is to disclose adjustable width doorway safety gate apparatus comprising two gate segments slidably attached each to the other by means of a flanged spool segment extending through slots in center bars of gate segments and flanges on the spool segment extending beyond the width of the slots and a locking and release means extending through the slots and flanges of the locking and release means extending beyond the width of the slots and a flexible reed attached on its end to the flange of locking and release means to lock the two gate segments slidably attached each to the other by means of a lock spool section attached to the flexible reed end opposite the end attached to flange of the locking and release means and the lock spool section extending through aligned holes in the slots in the center bar segments, to rigidly lock the two gate segments together and hinges mounted on outer vertical edge of one gate segment and gate lock latches comprising upper and lower gate lock U latches mounted on outer vertical edge of gate opposite the hinges and the upper and lower gate lock U latches connected together to act in concert by means of a connecting leg and a notched gate lock release lever attached to flexible section of gate lock lever release mounted on pivot fastener bearing and the notched gate lock release lever attached to the upper gate lock U latch and the gate assembly mounted in a doorway.

A further object of the invention is to disclose an adjustable width doorway safety gate apparatus wherein the improvement comprises center bars of gate segments which are flush with one surface of the outer periphery gate segments and the center bars ride on off set grooves and matching runners of the center bar segments.

DESCRIPTION OF DRAWINGS

FIG. 1. Showing safety guard gate segments in front elevation view wherein:

Figure 2:
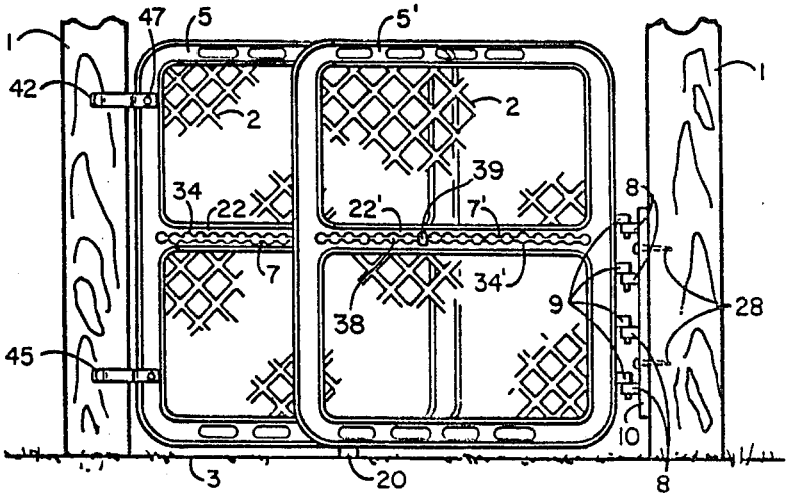
Figure 6:
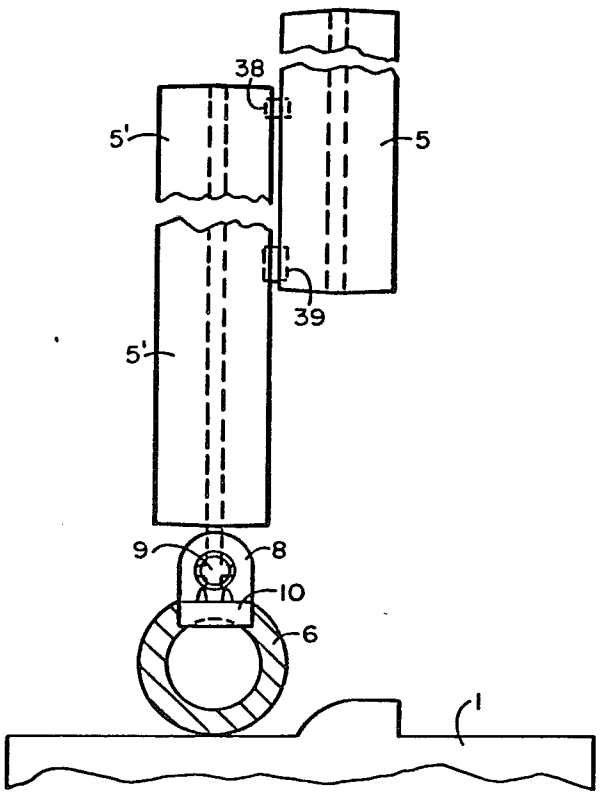
Figure 4:
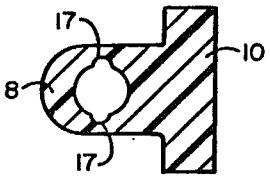
Figure 5:
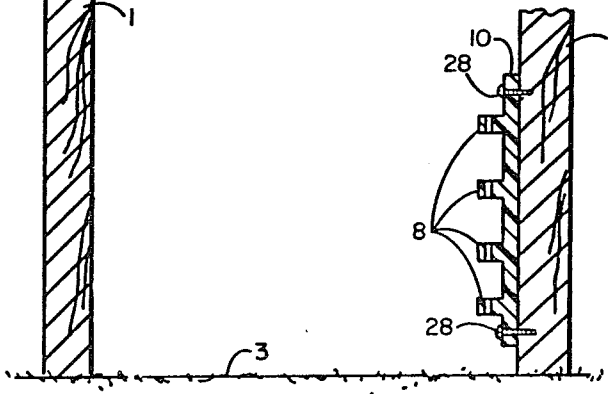
Figure 3:
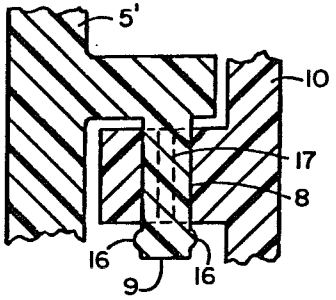
Figure 11:
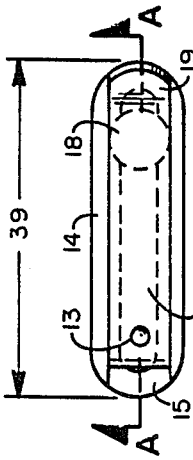

2 - Grill of gate segments
5,5' - Gate segments
9 - Hinge pins fingers
7,7' - Slots in gate center bar segment
20 - Gate sag bumpers
22,22' - Center bars of gate segment
34,34' - Slot holes in slots in gate center bar segment
42 - Upper gate lock U latch
45 - Lower gate lock U latch
47 - Button to actuate gate lock lever release FIG. 2. Showing safety guard gate components in front elevation view wherein:

1 - Door frame pillars
2 - Grill of gate segments
3 - Doorway threshold
5,5' - Gate segments
8 - Hinge pin sockets
9 - Hinge pins
10 - Hinge pin socket mount plate
20 - Gate sag bumper
22,22' - Center bars of gate segments
28 - Screws for mounting socket mount plate to door pillar
34,34' - Slot holes in slots in gate center bar segment
38 - Idler flanged spool assembly (see FIG. 14)
39 - Locking and release mechanism of center bars (see FIG. 11)
42 - Upper gate lock U latch
45 - Lower gate lock U latch
47 - Button to actuate gate lock lever release FIG. 3. Enlarged elevation view of hinge pins fitting in hinge pin sockets wherein:

5' - Gate segment
8 - Hinge pin socket
9 - Hinge pin
10 - Hinge pin socket mount plate
16 - Hinge pin key
17 - Ghost lines of hinge pin leg groove keyway slot FIG. 4. Enlarged plan view of hinge pin socket wherein:

8 - Hinge pin socket
10 - Hinge pin socket mount plate
17 - Hinge pin groove keyway slot FIG. 5. Elevation view of hinge pin socket mount plate attached to doorway pillar wherein:

1 - Doorway frame pillars
8 - Hinge pin sockets
10 - Hinge pin socket mount plate
3 - Doorway threshold
28 - Screws to attach hinge pin socket mount plate to doorway frame FIG. 6. Plan view of hinge pin socket mount plate attached to spring loaded pole and safety gate mounted thereon, wherein:

1 - Doorway frame pillar
5 - Gate segment
6 - Spring loaded pole
8 - Hinge pin socket
9 - Hinge pin finger
10 - Hinge pin socket mount plate
38 - Idler flanged spool assembly (see FIG. 14)
39 - Locking and release mechanism of center bars (see FIG. 11)

Figure 7:
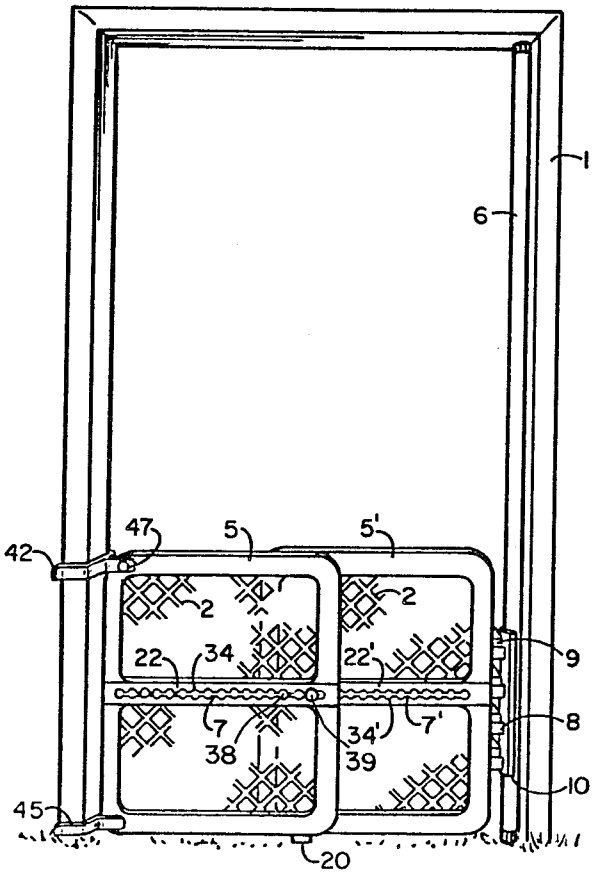

FIG. 7. Elevation view of safety gate unit mounted on hinge attached to spring loaded pole.

Figure 8:
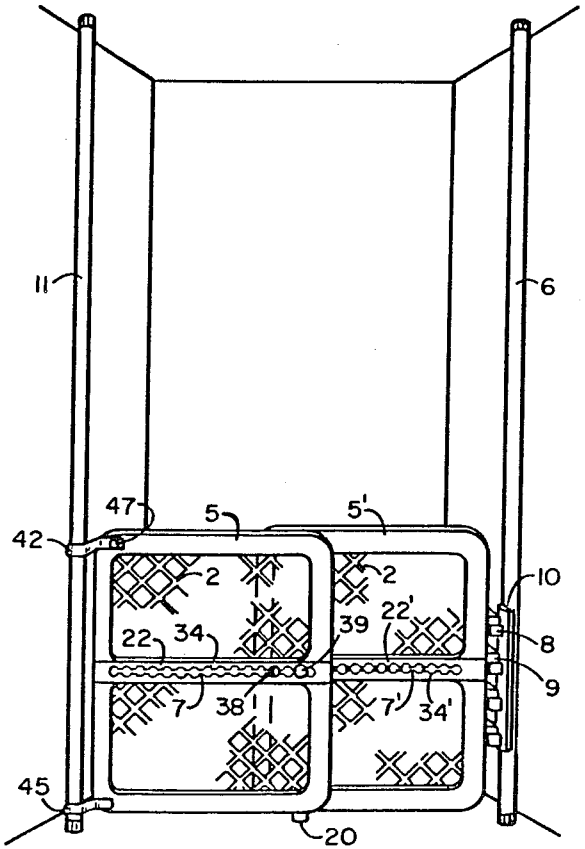

1 - Door frame pillar
2 - Grill of gate segments
5,5' - Attached gate segments
6 - Spring loaded pole
7,7' - Slots in center bar of each gate segment
8 - Hinge pin socket
9 - Hinge pin finger
10 - Hinge pin socket mount plate
20 - Gate sag bumper
22,22' - Center bars of gate segments
34,34' - Slot holes in slots in gate center bar segment
38 - Idler flanged spool (see FIG. 14)
39 - Locking and release mechanism of center bars (see FIG. 11)
42 - Upper gate lock U latch
45 - Lower gate lock U latch
47 - Button to actuate gate lock lever release FIG. 8. Elevation view of safety gate unit mounted on hinge attached to spring loaded pole and locking latch of swinging gate end engaging stop on spring loaded pole.

2 - Grill of gate segments
5,5' - Attached gate segments
6 - Spring loaded pole
7,7' - Slots in center bar of each gate segment
8 - Hinge pin socket
9 - Hinge pin
10 - Hinge pin socket mount plate
11 - Spring loaded stop pole
20 - Gate sag bumper
22,22' - Center bars of gate segments
34,34' - Slot holes in slots in gate center bar segment
38 - Idler flanged spool (see FIG. 14)
39 - Locking and release mechanism of center bars (see FIG. 11)
42 - Upper gate lock U latch
45 - Lower gate lock U latch
47 - Button to actuate gate lock lever release.

Figure 9:
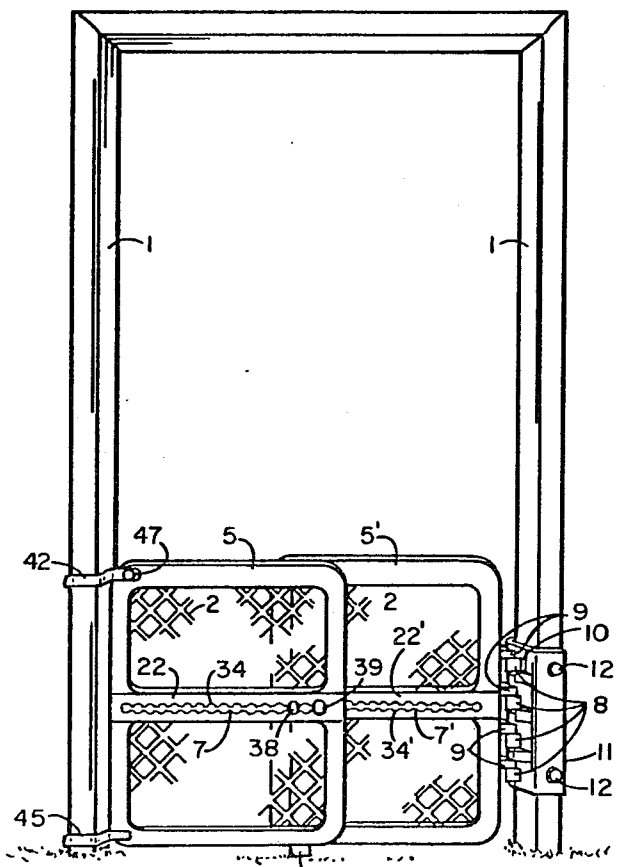

FIG. 9. Elevation view of safety gate unit mounted on hinge attached to clamp on unit fastened to door frame pillar.

Figure 10:
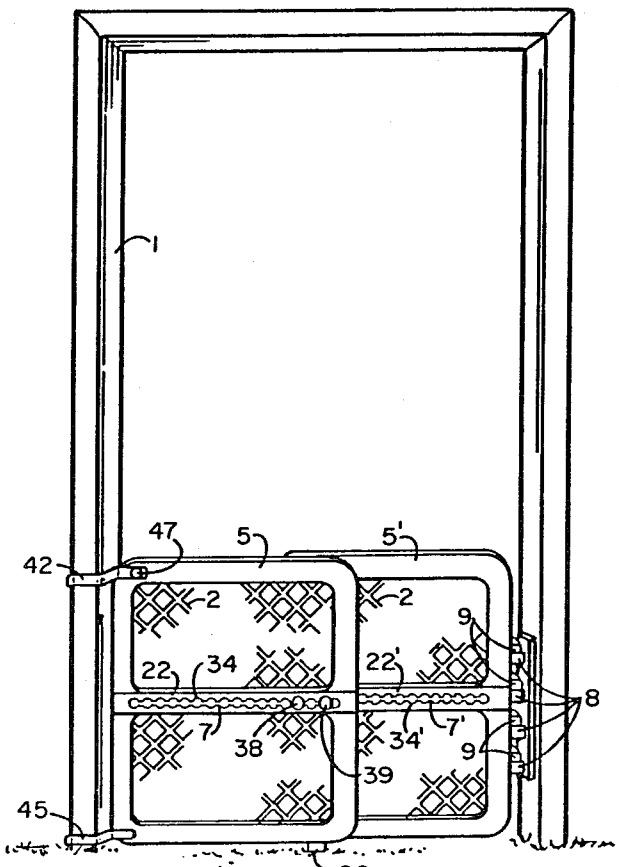

1 - Door frame pillar
2 - Grill of gate segments
5,5' - Attached gate segments
7,7' - Slots in each gate segment
8 - Hinge pin sockets
9 - Hinge pin fingers
10 - Hinge pin socket mount plate
11 - Socket mount plate clamp
12 - Clamp holding bolts
20 - Gate sag bumper
22,22' - Center bars of gate segments
34,34' - Slot holes in slots in gate center bar segment
38 - Idler flanged spool (see FIG. 14)
39 - Locking and release mechanism of center bars (see FIG. 11)
42 - Upper gate lock U latch
45 - Lower gate lock U latch
47 - Button to actuate gate lock lever release FIG. 10. Elevation view of saf ety gate apparatus mounted on hinge attached to door frame pillar.

5,5' - Gate segments
7,7' - Slots in center bar of gate segment
8 - Hinge pin socket
9 - Hinge pin fingers
22,22' - Center bars of gate segments
34,34' - Slot holes in slots in gate center bar segment
38 - Idler flange spool (see FIG. 14)
39 - Locking and release mechanism of center bars (see FIG. 11)
42 - Upper gate lock U latch
45 - Lower gate lock U latch
47 - Button to actuate gate lock lever release FIG. 11. Elevation view of locking and release mechanism fitting in and joining slots in center bars of gate segments.

13 - Fastener joining flanges 32 to body 31
14 - Flexible reed
15 - Flange
18 - Spool section
19 - Finger grip on flexible reed
31 - Body section
39 - Elevation view of assembled locking and release mechanism fitting in slots and joining center bars of gate segments.

Figure 13:
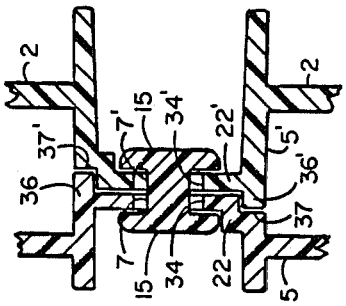
Figure 12:
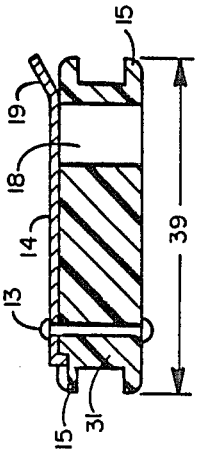

FIG. 12. Plan view of release mechanism fitting in and joining slots in center bars of gate segments wherein:

13 - Fastener joining flanges 32 to body 31
14 - Flexible reed
15 - Flanges
18 - Spool section lock
19 - Finger grip on flexible reed
31 - Body section FIG. 13. Showing enlarged elevation end view of slots in center bars of gate segments as held in position by flanged spool, 36 assembly of FIG. 11.

Figure 14:
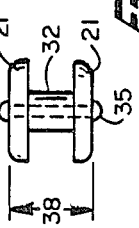

5,5' - Gate segments
7 - Slots in center bar segments
15 - Flanges on spool segment
22,22' - Center bar of gate segment
34 - Slot holes in slots in center bar of gate segment (see FIG. 15)
36,36' - Tongue on slide of center bars of gate segments
37,37' - Groove for tongue on slide of center bars of gate segments FIG. 14. Idler flanged spool.

21 - Flanged spool segment
32 - Spool section between flanges
35 - Fastener pin
38 - Edge elevation view of Idler flanged spool assembly joining center bar segments.

Figure 16:
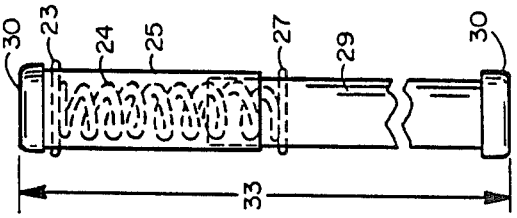
Figure 15:
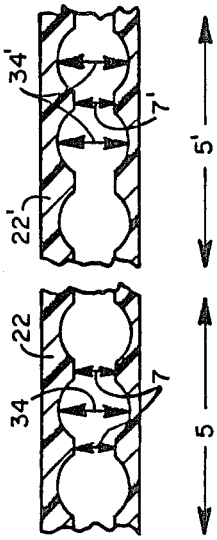
Figure 17:
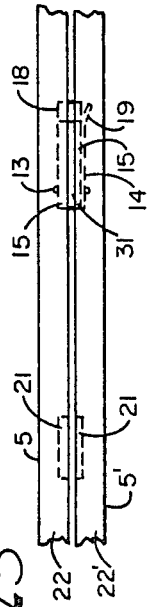

FIG. 15. Elevation view of slots in center bar segments wherein:

5,5' - Gate segment
7,7' - Slots in center bar of gate segment
22,22' - Center bar of gate segment
34 - Slot holes in slots in center bar of gate segment FIG. 16. Elevation of spring loaded pole wherein:

23 - Spring anchor fastener
24 - Compression coil spring
25 - Female pole segment
27 - Spring wind pin
29 - Male pole segment
30 - Rubber end bumpers of pole ends
33 - Assembled spring loaded pole FIG. 17. Plan view of center bar of gate segments 22 and 22' attached together adjusting gate to selected width wherein:

5,5' - Gate segments
13 - Fastener joining flanges 32 to body 31
14 - Flexible reed
15 - Flanges
19 - Finger grip on flexible reed
21 - Flanges on spool segment
22,22' - Center bars of gate segments
31 - Body section of fastener of center bars of gate segments FIG. 18. This is isometric elevation view of gate locking section of gate apparatus wherein:

5 - Gate segment
7,7' - Slots in center bar of each gate segment
22 - Center bar of gate segment
34 - Slot holes in slots in center bar of gate segment
41 - pivot fastener bearing upper
42 - Upper gate lock U latches
45 - Lower gate lock U latches
46 - Leg joining upper and lower gate lock U latches
48 - pivot fastener bearing for lower U latches
50 - Center web of gate segment
51 - Rims of periphery of gate sections joined by center web.

FIG. 19. Elevation view of mechanism to lock and unlock gate with the mechanism shown in the locked position, wherein:

5 - Gate segment
41 - pivot fastener bearing
42,42' - Upper gate lock U latches
43 - Notch in gate lock lever release
44 - Flexible section of gate lock lever release
46, - Legs joining upper and lower gate lock U latches
47 - Button to actuate gate lock flexible lever release FIG. 20. Elevation view of mechanism to lock and unlock gate showing the gate lock lever release in flexed unlock position, wherein:

5 - Gate segment
41,41' - Pivot fastner bearings
42,42 - Upper gate lock U latches
43 - Notch in gate lock lever release
44 - Flexible section of gate lock lever release
46' - Legs joining upper and lower gate lock U lever latches.

Figure 21:
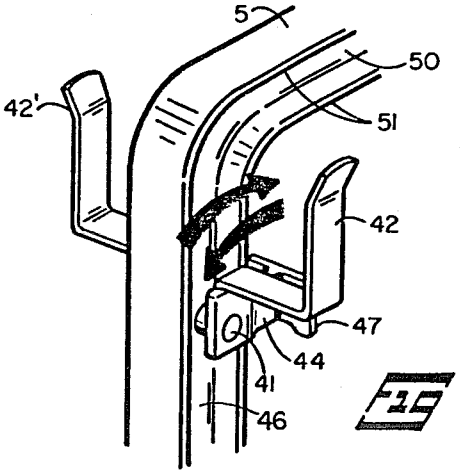

FIG. 21. Elevation view of mechanism to lock and unlock gate showing the gate lock lever release latch in flexed unlocked position, and rotated 90 degrees to release gate lock U lever latch from gate stop to allow gate to swing open, wherein:

5 - Gate segment
40 - Gate lock flexible lever release
42,42' - Upper gate lock U latches
44 - Flexible section of gate lock lever release
46 - Legs joining upper and lower gate lock U latches.

Figure 1:
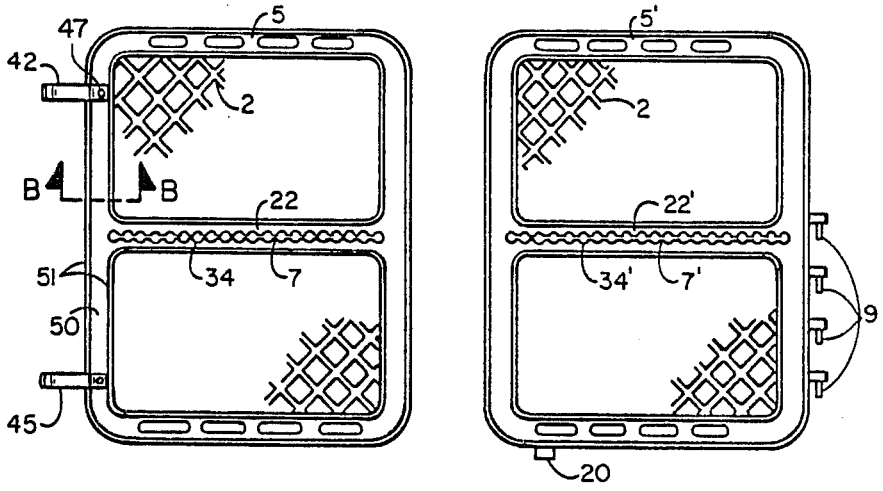
Figure 23:
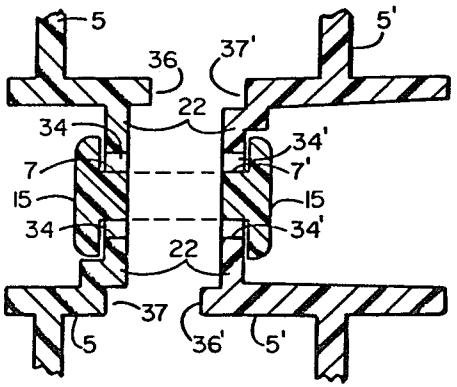
Figure 22:
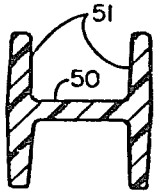

FIG. 22. This is section B—B of FIG. 1, showing configuration of periphery of gate sections wherein:

50 - Center web of "H" section
51 - Rims of periphery of gate sections joined by center web, FIG. 23. This is an exploded enlarged elevation end view of FIG. 13 assembly showing tongue and groove prior to fitting together of the center bar segments wherein:

5,5' - Gate segments
7,7' - Slots in center bar segments
15 - Flanges on spool segment
22,22' - Center bar of gate segment
34 - Slot holes in slots in center bar of gate segment (see FIG. 15)
36,36' - Tongue on slide of center bars of gate segments
37,37' - Grooves for tongues on slide of center bars of gate segments.

DETAILED DESCRIPTION OF INVENTION

Adjustable width doorway safety gate apparatus of this invention comprises two gate segments 5 and 5' fastened together by means of release mechanism fitting in and joining overlapping grooves 7 in each gate segment. These grooves in each gate segment 7, are located in 22,22' center bars of gate segments. The release mechanism of FIGS. 11 and 12 fitting in and joining overlapping gate segments, is positioned in the slots 7, located in center bars of gate segments 22,22'.

The release mechanism is comprised of fastener 13 joining flanges 15 to body section 31, and flexible reed 14 fastened on one end by means of 13 fastener joining flanges 15 to body 31. On the flexible reed 14 on the end opposite the fastener 13 there is finger grip 19 on flexible reed end, and this finger grip 19 is set at an angle of about 45 degrees, The spool section 18 is attached to flexible reed 14, such that as flexible reed 14 is raised by lifting the end 19 the spool section 18 is then withdrawn from matching slots 7,7' and holes 34 and 34' in center bars 22, 22' of gate segments, to allow the gate segments 5 and 5' to be adjusted for suitable doorway width.

The hinges are comprised of hinge pin fingers 9 pointing downwards, and rigidly attached to the outer vertical edge of gate segment 5' for example, and these hinge pin fingers 9 are inserted in hinge pin sockets 8, hinge pin sockets 8 are mounted on hinge pin socket mount plate 10, and hinge pins 9 are held in hinge pin sockets 8 by means of hinge pin keys 16. The hinge pin keys 16 can be withdrawn through hinge pin socket 8 only when the hinge pins are aligned with hinge pin groove keyway slots 17. The hinge pin keys 16 are so aligned with the gate half 5 that the keys 16 can be aligned with hinge pin groove keyway slot 17 only when the gate halves are full open, or 90° from closed.

Gate sag bumper 20, prevents the hinge pin fingers 9 from being damaged when the gate is stressed downward, such as by a youngster crawling on top of the gate segments.

The adjustable width safety gate apparatus of this invention may be hung or mounted, see FIGS. 7 and 8, by attaching the hinge pin socket mount plate 10 to a spring loaded pole 6, then mounting the width adjusted gate segments 5–5' with the hinge pin fingers 9, attached to an outer vertical gate edge, in hinge pin sockets 8.

The spring loaded pole 6 comprises a male pole segment 29 and a female pole segment 25 and a spiral compression coil spring 24 firmly attached at one end of the spring 24 to a spring anchor fastener 23 at the closed end of the female pole segment 25, capped by a rubber end bumper 30 at the female pole end, The end of the spiral compression coil spring 24, opposite the end attached to the spring anchor 23 will extend into the male pole segment 29 and be threaded around spring wind pin 27 to adjust the compression of the spring 24 to rigidly hold the assembled spring loaded pole 33, having rubber end bumpers of pole ends 30 at each end (top and bottom) of the assembled pole.

The adjustable width gate can be mounted on a spring loaded pole, as disclosed above, or the mounting can be made on the doorway Pillar frame as shown in FIG. 9, which discloses in elevation view, of safety gate unit mounted on doorway f rame pillar 1, wherein attached gate segments 5–5', with hinge pin fingers 9 attached to the outer vertical edge of segment 5', and the hinge pin fingers 9 are mounted in hinge pin sockets 8, and hinge pin sockets 8, attached to hinge pin socket mount plate is rigidly attached to socket mount plate clamp 11, the socket mount plate clamp 11 is rigidly attached to door frame pillar 1 by means of clamp holding bolts 12, To adjust the gate segments 5,5' to the proper width, to fit in a doorway opening, the slots in center bar of gate segment 7,7' are aligned and in side to side contact, as shown in FIG. 14 and are fastened together by means of idler flanged spool comprising a f langed spool segment and wherein the body portion 32 of the flanged spool segment is of such dimension to freely slide in slots 7 in center bars of gate segments and the flanges 21 extend beyond the width of the slots. In addition to above flanged spool segment or idler flanged spool the gate segments are further held together in side to side contact by means of elongated spool body section 31, which is of such thickness to slide freely in slots 7,7' in center bar of gate segments 5,5'. On tightening the flanges 15, the gate segments 5,5' are held rigidly adjusted to width, when spool section 18 is inserted in slot holes 34 in slots in center bars of gate segments.

To adjust the width of the gate segments 5,5' before fastening the flanges 21 on the spool sections 32 fitting in slots in center bar of gate segment, the flexible reed 14 fastened on one end to flange 15 and the opposite end of the flexible reed has mounted thereon a spool section 18 which is of such diameter to fit in the slot holes 34,34' of the aligned slots in center bar of gate segments 7,7'. See FIG. 11 legend 36, locking mechanism.

The slot holes 34,34' mentioned above are enlarged areas of the slots 7,7'.

On the spool end section of the flexible reed 14 is a finger grip 19, which serves to provide a grip to raise the spool section 18 out of the holes 34,34' to adjust the gate segments 5,5' to the proper width, then the finger grip 19 is released to drop the spool section 18 into aligned holes 34,34' in slots 22,22'.

In regard to latching the assembled gate segments in a doorway, reference is now made to FIGS. 18, 19 and 20. The latching mechanism comprises gate lock flexible lever release 44, actuated by pushing button 47 outward to release notch in gate lock lever release 43 from gate segment 5, see FIG. 19, and flexible lever release 44, is rotated back and forth 90 degrees on pivot fastener 41, and upper gate lock U latches 42,42' and lower gate lock U latches 45,45' connected together by legs 46,46' are raised upward as shown in FIG. 20 to release the latches from the locked position to allow the gate to swing open. The gate lock U latches are lowered to straddle the gate stop pillar or spring mounted pole by rotating flexible lever release 40 counter clockwise.

In all of the above discussion when legends with the prime (') are used, this indicates similar configuration to the same number but without the prime (').

Further description of the invention may be described as an adjustable width doorway safety gate apparatus comprising two gate segments, 5,5' slidably attached each to the other by means of an Idler flanged spool segment 38 extending through slots in center bars 22,22' of gate segments and flanges 21 on the Idler spool segment 32 extending beyond the width of the slots 7,7' and spaced apart from the Idler spool segment, a locking and release means 18 extending through slot holes 34 and flanges 15 of the locking and release means extending beyond the width of the slots and a flexible reed 14 attached on its end to the flange 15 of locking and release means to lock the two gate segments 5,5' slidably attached each to the other by means of a lock spool section 18 attached to the flexible reed end 19 and the opposite end of the reed attached to flange 15 of the locking and release means and the lock spool section 18 extending through aligned slot holes 34 in the slots 7 in the center bar segments 22, to rigidly lock the two gate segments 5,5' together and hinges 9 mounted on outer vertical edge of one gate segment 5' and gate lock latches 42,42' and 45,45' comprising upper 42,42' and lower 45,45' gate lock U latches mounted on outer vertical edge of gate 5 opposite the hinges 9 and the upper and lower gate lock U latches connected together to act in concert by means of a connecting leg 46 and a notched gate lock release lever 47 attached to flexible section 44 of gate lock lever release 47 mounted on pivot fastener 41 bearing and the notched gate lock release lever 47 attached to the upper gate lock U latch 42,42' and the gate assembly 5,5' mounted in a doorway.

The gate assembly may be hung or mounted on hinges attached to a doorway pillar, or the hinges may be mounted on a spring loaded pole and the assembled gate hung thereon.

The above disclosed adjustable width doorway safety gate apparatus comprises center bars 22,22' flush with one surf ace of the gate outer periphery 51 of the gate segments and the center bars 22,22' ride on offset grooves 37,37' and runners 36 and 36' (see FIG. 23). The above then allows the gate segments to be molded of thermoplastic and the tongue and grooves then mesh together on inverting one gate segment so that the mirror image of the center bar segments fit together.

Having described my invention, I claim:

1. Adjustable width doorway safety gate apparatus wherein the improvement comprises;

two gate segments slidably attached each to the other, by means of an idler flanged spool segment extending through slots in center bars of gate segments and flanges on said spool segment extending beyond the width of said slots and spaced apart from said idler flanged spool segment, a locking and release means extending through said slots and flanges of said locking and release means extending beyond the width of said slots and a flexible reed attached on its end to said flange of locking and release means and means to lock the said two gate segments slidably attached each to the other by means of a lock spool section attached to said flexible reed end opposite end attached to flange of said locking and release means and said lock spool section extending through aligned holes in said slots in center bar segments, to rigidly lock the two gate segments together, and hinges mounted on outer vertical edge of one gate segment, and gate lock latches comprising upper and lower gate lock U latches mounted on outer vertical edge of gate opposite the hinges, and said upper and lower gate lock U latches connected together to act in concert, by means of a connecting leg, and a notched gate lock release lever attached to flexible section of gate lock lever release mounted on pivot fastener bearing, and said notched gate lock release lever attached to said upper gate lock U latch, rotatable 90 degrees back and forth to activate upper and lower gate lock U latches to straddle and release gate stop pillar for locking of safety gate mounted in a doorway.

2. Adjustable width doorway saf ety gate apparatus of claim 1 of two gate segments slidably attached each to the other, wherein the improvement comprises:

center bars of gate segments and said center bars are flush with one surface of said gate segments and said center bars ride on of fset grooves and matching runners of said center bars.

3. Adjustable width doorway safety gate apparatus of claim 1 wherein the improvement comprises:

two gate segments slidably attached each to the other and hinges mounted on outer vertical edge of one gate segment, said hinges consisting of hinge pins pointed downward and mounted on edge of one gate segment, and said hinge pins of gate segment mounted in hinge pin sockets mounted on spring loaded pole in doorway and keyways in said hinge pin sockets and hinge pin key segments on bottom end of said hinge pins.

* * * * *